US008671804B2

(12) United States Patent
Galat

(10) Patent No.: US 8,671,804 B2
(45) Date of Patent: Mar. 18, 2014

(54) FASTENER INSTALLATION TOOL WITH QUICK CHANGE KEY

(75) Inventor: Michael Edward Galat, Clinton Township, MI (US)

(73) Assignee: Michael Edward Galat, Troy, MI (US)

( * ) Notice: Subject to any disclaimer, the term of this patent is extended or adjusted under 35 U.S.C. 154(b) by 269 days.

(21) Appl. No.: 13/350,856

(22) Filed: Jan. 16, 2012

(65) Prior Publication Data

US 2013/0180364 A1 Jul. 18, 2013

(51) Int. Cl.
*B25B 21/00* (2006.01)
*B25B 23/00* (2006.01)

(52) U.S. Cl.
CPC ..... *B25B 21/002* (2013.01); *B25B 23/0085* (2013.01)
USPC ..... 81/56; 81/57.14

(58) Field of Classification Search
USPC ..... 81/55, 56, 57.14, 57.3
See application file for complete search history.

(56) References Cited

U.S. PATENT DOCUMENTS 3,027,789 A 4/1962 Bochman
3,323,394 A 6/1967 Bangerter et al.
3,584,527 A 6/1971 Bosten
4,462,281 A 7/1984 Zills
4,538,483 A 9/1985 Batten
4,617,844 A 10/1986 Batten
5,184,530 A 2/1993 Galat
5,305,666 A 4/1994 LaTorre
5,544,553 A 8/1996 Galat
5,553,519 A * 9/1996 Pettit, Jr. ..... 81/56
5,778,741 A 7/1998 Batten
5,940,950 A 8/1999 Galat
6,055,887 A 5/2000 Galat
6,619,159 B2 9/2003 Galat
6,935,209 B2 8/2005 Lantow et al.
6,959,625 B2 11/2005 Pettit, Jr.
7,287,447 B2 10/2007 Pettit, Jr.
7,874,232 B2 1/2011 Gauthreaux et al.

* cited by examiner

*Primary Examiner* — David B Thomas

(57) ABSTRACT

An improved fastener installation tool is provided that is used to install a threaded nut onto a threaded fastener bolt where access to the bolt head is not possible. The fastener bolt has a threaded shank with a noncircular recess that is adapted to receive a complimentary shaped hex key or hold bit installed in a socket gear of a power driven tool which is used to install a threaded nut onto the threaded shank of the fastener bolt. A spring biased retainer slide with an extended rod portion hold the hex key securely in a locked position. Manual retraction of the retainer slide allows the extended rod portion to release the hex key so it may be replaced when damaged without any need for any further disassembly or need for additional disassembly tools.

22 Claims, 4 Drawing Sheets

FASTENER INSTALLATION TOOL WITH QUICK CHANGE KEY

CROSS-REFERENCE TO RELATED APPLICATIONS

Not applicable.

STATEMENT REGARDING FEDERALLY SPONSORED RESEARCH

Not applicable.

REFERENCE TO SEQUENCE LISTING

Not applicable.

BACKGROUND OF THE INVENTION

1. Field of the Invention

The invention relates generally to improvements in power tools used in the installation of threaded fasteners and more particularly, to a quick-change socket and key retainer assembly for specialized threaded fasteners of the type used in aerospace and related industries.

2. Brief Statement of the Prior Art

A variety of specialized fasteners have been developed and are widely used in the aerospace and related industries. These specialized fasteners have been designed to meet specific design criteria for a variety of applications. One such fastener is currently in widespread use throughout the aerospace industry. The Hi-Lok® type fastener was developed by Hi-Shear Corporation and is manufactured under a variety of names. The Hi-Lok® type fastener is particularly adapted for fastening two or more metal panels or workpieces together where there is no access to the bolt head. That is, the fastener is designed to fit through a preformed opening in a substrate or workpiece with the bolt head inaccessible by the power tool used in the installation of the fastener.

The Hi-Lok® type frangible fastener includes two basic components, a bolt component which has a bolt or head end and a threaded end, and a collar component which has an internally threaded body portion and a torque limiting drive nut portion. Generally, a series of appropriately spaced holes are bored in the workpiece. One of the most important features of this fastener is that it enables the fasteners to be installed with the installation tooling disposed on one side of the workpiece assembly.

The bolt component is inserted from the opposite side of the panel assembly, that is, the side inaccessible to the power tooling. The body of the collar component of the fastener is then threaded a few turns onto the exposed threaded end of the bolt component from the accessible side of the workpiece assembly.

The power tooling that drives the fastener includes a rotary socket member which has a forwardly opening noncircular, preferably hex recess that engages the torque limiting drive nut portion of the collar component. In addition to the hex socket, the power tooling has a centrally located rotationally stationary noncircular, preferably hex key or hold bit which is adapted to snugly fit into a broached hex cavity located in the threaded end portion of the bolt component of the fastener. The rotary socket member is rotated by a powered motor in the power tool body, and threadedly drives the collar component of the threaded fastener down onto the bolt component until a predetermined torque preload on the workpiece assembly is reached. At the same time that the collar component is threaded onto the threaded bolt component the rotationally stationary noncircular or hex key or hold bit mounted to the broached hex cavity in the threaded shank of the bolt component holds the fastener against rotation. Upon reaching the predetermined torque limit, the drive nut portion of the collar component is automatically sheared from the threaded body of the collar component which then becomes the nut portion of the fastener. This unique feature avoids over-torquing the fastener as well as eliminates the need for manually monitoring the torque on the fastener.

A problem that continues to exist with this type of fastener installation tool is the tendency of the hex key or hold bit to twist or otherwise deform. Additionally, changing the hex key or hold bit after damage or after wear or to a different size key is a relatively slow procedure due to the various mechanisms proposed to prevent the hex key or hold bit from rotating relative to the fastener during installation of the nut.

The prior art proposes various power tools for the installation of Hi-Lok® type frangible fasteners. Zils, U.S. Pat. No. 4,462,281, discloses a straight drive type of tool wherein the socket and hex key approach the workpieces at right angles relative to the general plane of the workpieces. The Zils tool has the disadvantage that if the key is damaged or broken, disassembly of portions of the head assembly of the tool is required in order to remove and replace the hex key. It also has the disadvantage that the key may be difficult to remove because of sealant fouling, and a twisted hex key may not even be removable for replacement, or may damage the key holder, requiring almost complete disassembly of the tool head for removing the stuck key and its key holder. These disadvantages translate into substantial manual effort and tool downtime.

Bochman, U.S. Pat. No. 3,027,789, discloses a geared L-head-type tool that might be applicable to a Hi-Lok® type frangible fastener, although there is no mention of a frangible fastener in this patent. Replacement of the key would require disassembly of a sub-housing which houses an enlarged key head and key spring from the main tool head. This would require substantial manual effort and tool downtime.

Bosten, U.S. Pat. No. 3,584,527, discloses a power tool which, by its nature, could be applied to a Hi-Lok® type frangible fastener, although its stationary key has a Phillips screwdriver-type head. It is a straight, offset drive which would require substantial disassembly, and hence manual effort and tool downtime, to remove and replace the bit or key.

Bangerter et al., U.S. Pat. No. 3,323,394, discloses a straight drive power tool which is generally similar to the tools disclosed in both Bosten and Zils, but has a torque-limiting clutch associated with the bolt-restraining bar. As with both the Bosten and Zils devices, the Bangerter al. device would require substantial disassembly to remove and replace a broken bar or key, requiring substantial effort and downtime. The binding problem discussed in connection with Zils would also be equally applicable to Bosten and Bangerter et al.

Batten, U.S. Pat. Nos. 4,538,483 and 4,617,844, disclose what purports to be a ball detent type quick-release and replacement system for removal of a damaged or broken drive head of the tool. There are a number of drawbacks with the ball-detent type of retention systems. The key has to be manually pulled out of the front end of the holder which requires a separate gripping tool such as pliers. For removal and replacement of the hex key, the ball detent system requires that the key holder be pulled rearwardly against the force of the retention spring, and then a "flipper" or spacer block be pivoted under the head of the holder to bring the detent in the holder into axial registry with the internal annual groove in the socket member. The retention springs are sometimes so rigid as to require a special tool to pry them up in order to get the flippers underneath them.

Another problem with the ball detent retention system is that contamination entering the interface region between the hex key and the holder key way often prevents extraction of the key from the key holder.

Gauthreaux et al., U.S. Pat. No. 7,874,232, discloses a quick connect socket and hex key retainer assembly wherein a lever is slid in one direction to lock the retaining slide into locked position. When the retaining slide is moved into the locked position, the retaining slide slides into and engages an annular groove that is located around the circumference of the exterior surface of the drive shaft of the socket of the socket assembly. Once the retainer slide is engaged with the annular groove, the socket assembly is secured and engaged to the gear head of the fastening tool with a lock screw. In order to change a hex key the complete socket assembly must be removed and disassembled from the power tool.

There exists, therefore a need for further improvements in and to fastener installation tools of the type having a hex key or hold bit coaxially disposed within a power drive socket for engaging a hex cavity located in the threaded end portion of the bolt component of a Hi-Lok® style fastener, particularly with respect to providing a simplified quick connect or disconnect feature for replacing the hex key or hold bit member.

SUMMARY OF THE INVENTION

In accordance with the invention, an improved fastener installation tool is provided of the type having a hex key or hold bit retainer assembly for engagement with a mating recess in the shank end of a threaded fastener while an accompanying power driven socket drives a threaded nut onto the threaded fastener shank using any convenient pneumatic or power driven tool. The fastener installation tool consists of a tool component and a drive head. Generally the fastener installation tool includes a torque overload clutch within the tool component to permit the hex key or hold bit retainer rotation in response to a torque load exceeding a predetermined limit thereby preventing hex key or hold bit retainer breakage. The improved fastener installation tool is adapted for quick and easy disengagement of the hex key or hold bit retainer thereby allowing quick and easy hex key removal and replacement.

The preferred embodiment of the quick disconnect installation tool consists of a tool head having an elongated hex key or hold bit coaxially mounted within a rotatably driven socket associated with a power driven device for power driven socket rotation. The hex key or hold bit is held rotatably fixed but longitudinally movable relative to the power drive socket for retraction therein as the power drive socket advances a threaded nut on the threaded shank of the bolt. The hex key or hold bit retainer tip has a noncircular cross-section (preferably a hexagonal cross-section) for seating into a mating recess formed in the threaded shank end of the bolt so as to support and hold the bolt against rotation during installation of the threaded nut onto the threaded shank of the bolt.

The fastener installation tool has a tool head, a gear drive consisting of a series of gears ending with a socket gear. The socket gear has at one end a gear configuration on its exterior surface which is adapted to mesh with one of the series of gears of the gear drive. A hex key or hold bit arrangement is coaxially disposed with the socket gear which houses a rotationally stationary hex key or hold bit which is longitudinally moveable relative to the socket gear against the action of a biasing spring. The gear drive and socket gear are disposed within the tool head. The gear configuration on the exterior surface of the drive socket matingly engages one of the series of gears disposed within the tool head. The hex key or hold bit has a shank with a noncircular exterior surface (preferably a hexagonal cross-section) and a tip with a noncircular external surface (preferably a hexagonal cross-section). The shank of the hex key or hold bit is disposed coaxially with the drive socket. The tip of the hex key or hold bit has a tip end that matingly engages a complementary shaped noncircular recess in the shank of the fastener or bolt.

It is therefore a primary object of the present invention to provide a novel Hi-Lok® installation tooling system having a true quick-release and replacement retention system for the hex key or hold bit yet is greatly simplified relative to prior art retention systems.

Another object of the present invention is to provide a hex key retention system which enables simple manual removal of only the hex key for replacement and requires no additional tools or further disassembly of other components of the tool head.

A further object of the present invention is to provide a Hi-Lok® installation tooling system wherein hex key ejection and replacement from the key holder is by simple manual manipulation of an externally exposed spring biased slide retainer instead of requiring that the key holder be removed from the socket component which holds the hex key with a set screw and roll pin.

A still further object of the present invention is to provide a Hi-Lok® type frangible fastener installation tooling system which is a substantial improvement over conventional Hi-Lok® installation tool systems currently in use.

These and other features and advantages of the present invention will become apparent from the following more detailed description taken in conjunction with the accompanying drawings which illustrate by way of example, the principals of the present invention.

DETAILED DESCRIPTION OF THE PREFERRED EMBODIMENT

Specialized threaded fasteners are often utilized in applications where there is no access to the bolt head. In such applications, it is well known that Hi-Lok® type fasteners are adapted to fasten two or more metal panels or workpieces together where there is no access to the bolt head. Hi-Lok® type fasteners require the use of a fastener installation tool having a hex key or hold bit which is inserted into a complementary broached recess in the shank end of a bolt type fastener to hold the fastener stationary while a noncircular (usually hex head) threaded nut is threaded onto the threaded shank of the bolt fastener by use of a power driven socket that is attached to a power driven installation tool. When the threaded nut is completely threaded onto the shank end of a bolt with the fastener installation tool and the bolt is restrained against rotation by the hex key or hold bit, the fastener is properly secured. In many such fastener installation tools, it is very difficult and time consuming to remove and replace the hex key or hold bit from the socket of the fastener tool when a hex key or hold bit breaks or is damaged and requires replacement. Such problem also exists when it is necessary to replace the hex key or hold bit when the size of the socket is changed to a larger size and the broached recess of a large size bolt type fastener increases in size. Therefore, an object of the present invention is to provide a fastener installation system that provides a quick disconnect arrangement for the hex key or hold bit which can be exercised with minimum disruption of the gear head or socket assembly and is accomplished quickly without using any hand tools.

Figure 1:
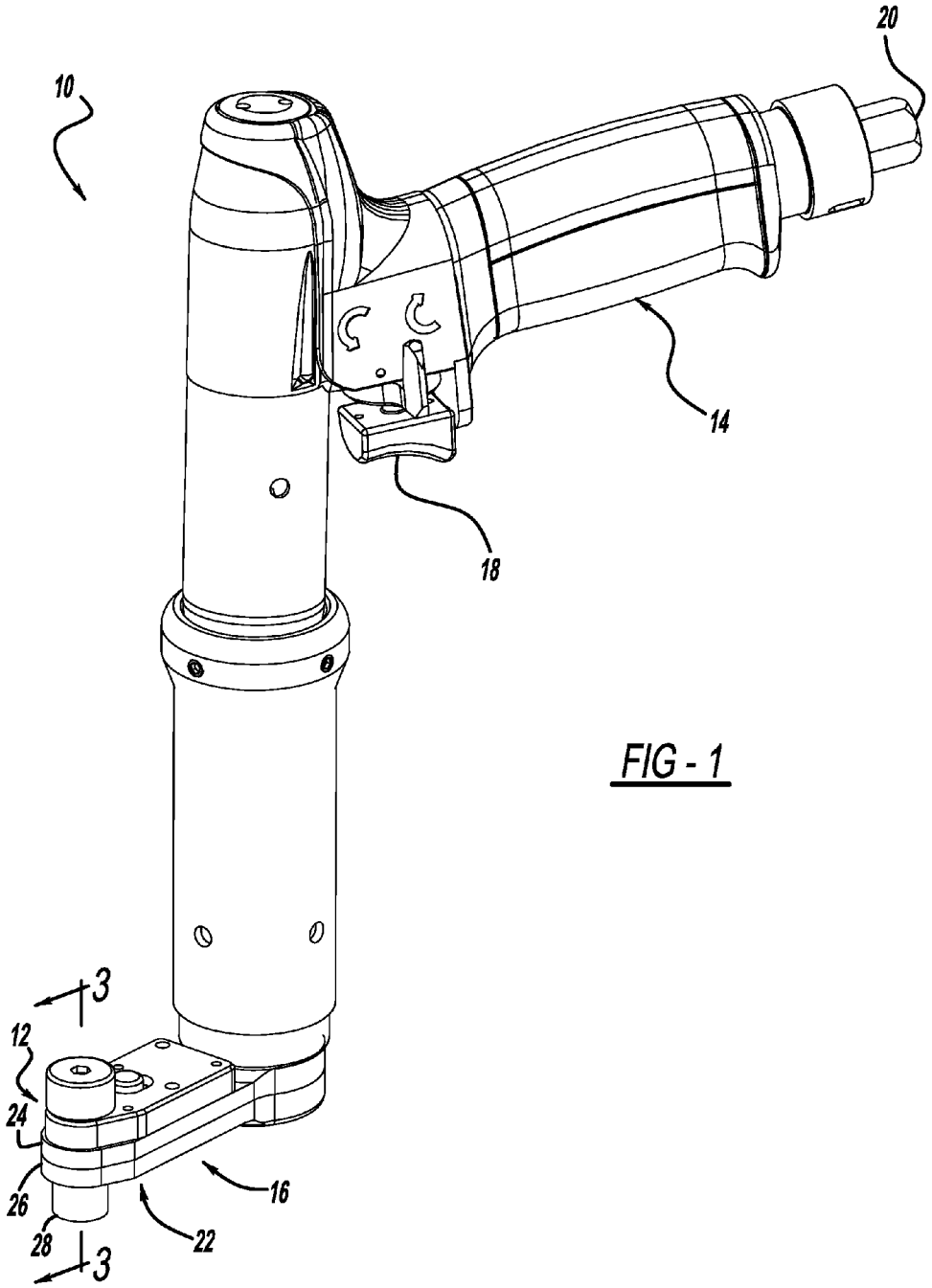
FIG. 1 is an isometric view of the fastener installation tool engaged with the gear drive head and retainer slide housing in accordance with the present invention.

FIG. 1 is an isometric view of a fastener installation tool 10 engaged to a tool attachment assembly 12. The fastener installation tool 10 shown has a tool component 14 and the tool attachment assembly 12 has a gear head 16. The tool component 14 is shown as having a power lever 18 and a pneumatic port 20. During the use of the pneumatic port 20 is connected to at least one pneumatic hose (not shown), which in turn is connected to at least one pneumatic pressure source (now shown). Alternatively, the fastener installation tool 10 may be powered by various other types of drive devices including, but not limited to, hydraulic energy, direct current (DC), or alternating current (AC) electricity, battery power or any other power energy provider. In the illustrated device the power lever 18 must be depressed in order for the fastener installation tool 10 to be powered on. In other power driving devices, various other types of switches, buttons, or levers may be employed instead of the power lever 18 shown in FIG. 1.

Figure 2:
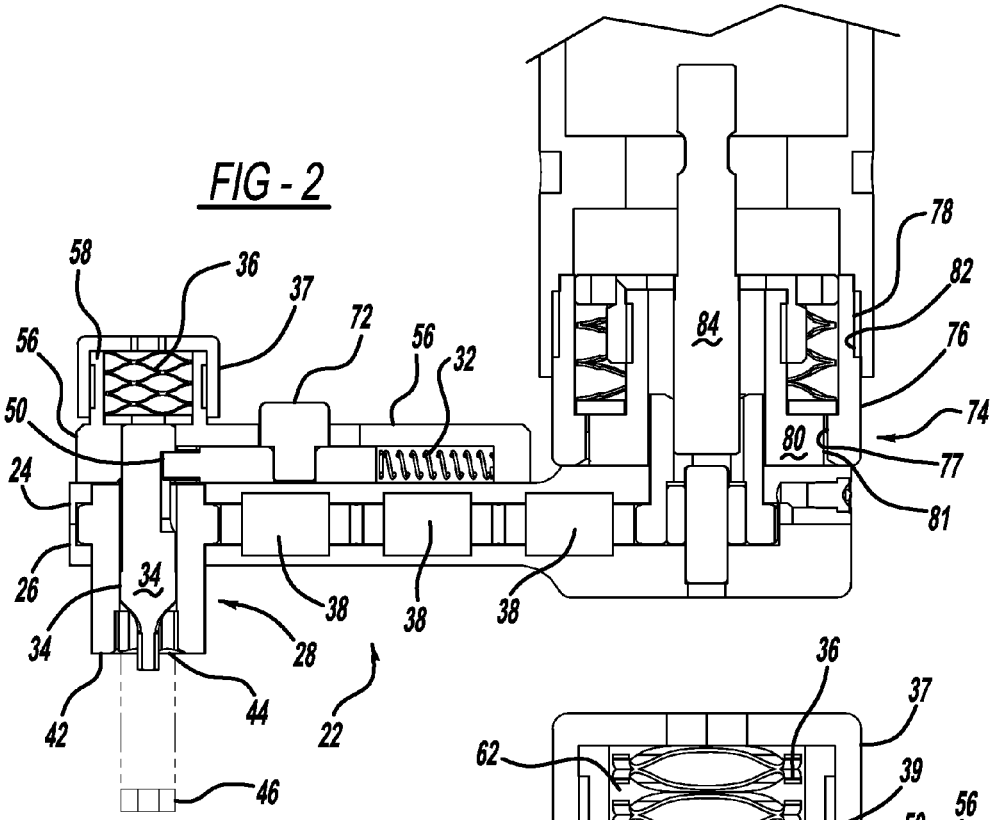
FIG. 2 is a partial cross-sectional view of the gear housing of the gear drive of the fastener installation tool in accordance with the present invention.
Figure 3:
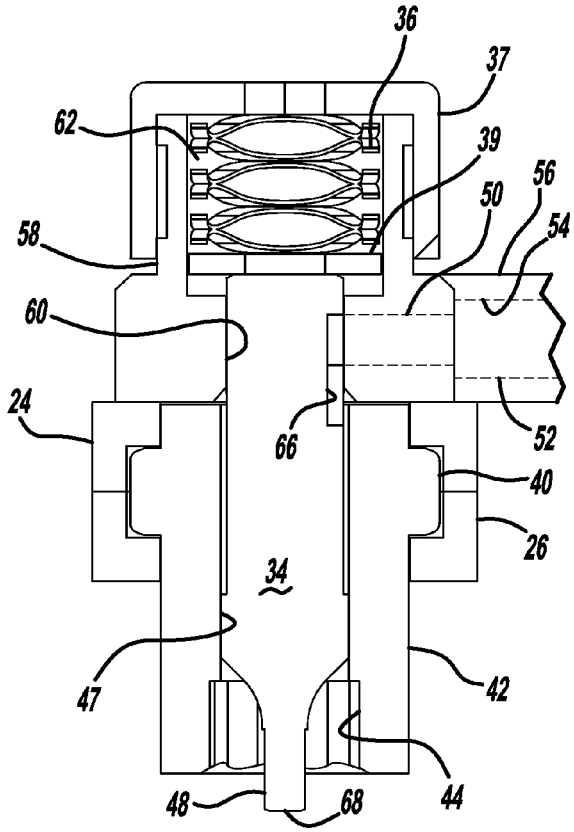
FIG. 3 is a partial cross-sectional view of the socket assembly and associated hex key or hold bit in accordance with the present invention disclosed herein.
Figure 4A:
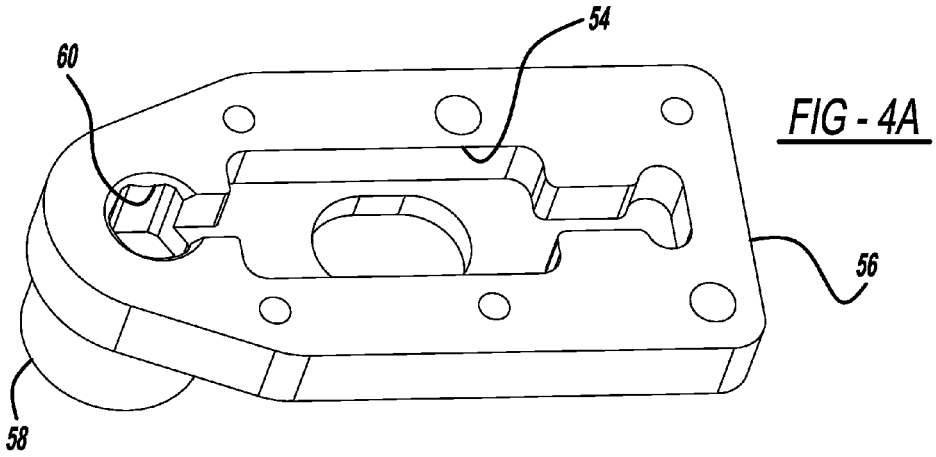
FIG. 4A is an isometric view of the retaining slide housing in accordance with the present invention.
Figure 4B:
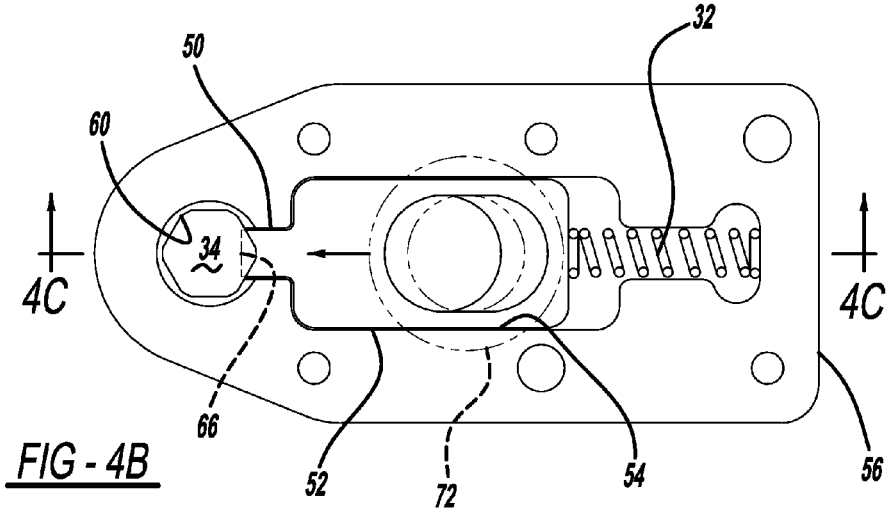
FIG. 4B is a bottom view of the retainer slide mounted in the retainer slide housing holding the hex key or hold bit to prevent it from turning in accordance with the present invention.
Figure 4C:
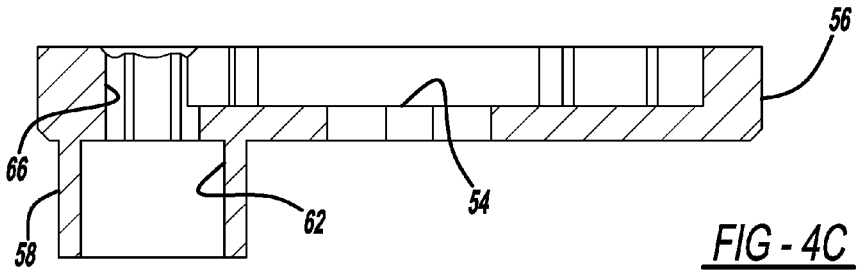
FIG. 4C is a cross-sectional view of FIG. 4B along arrows 4-4 in accordance with the present invention.
Figure 5:
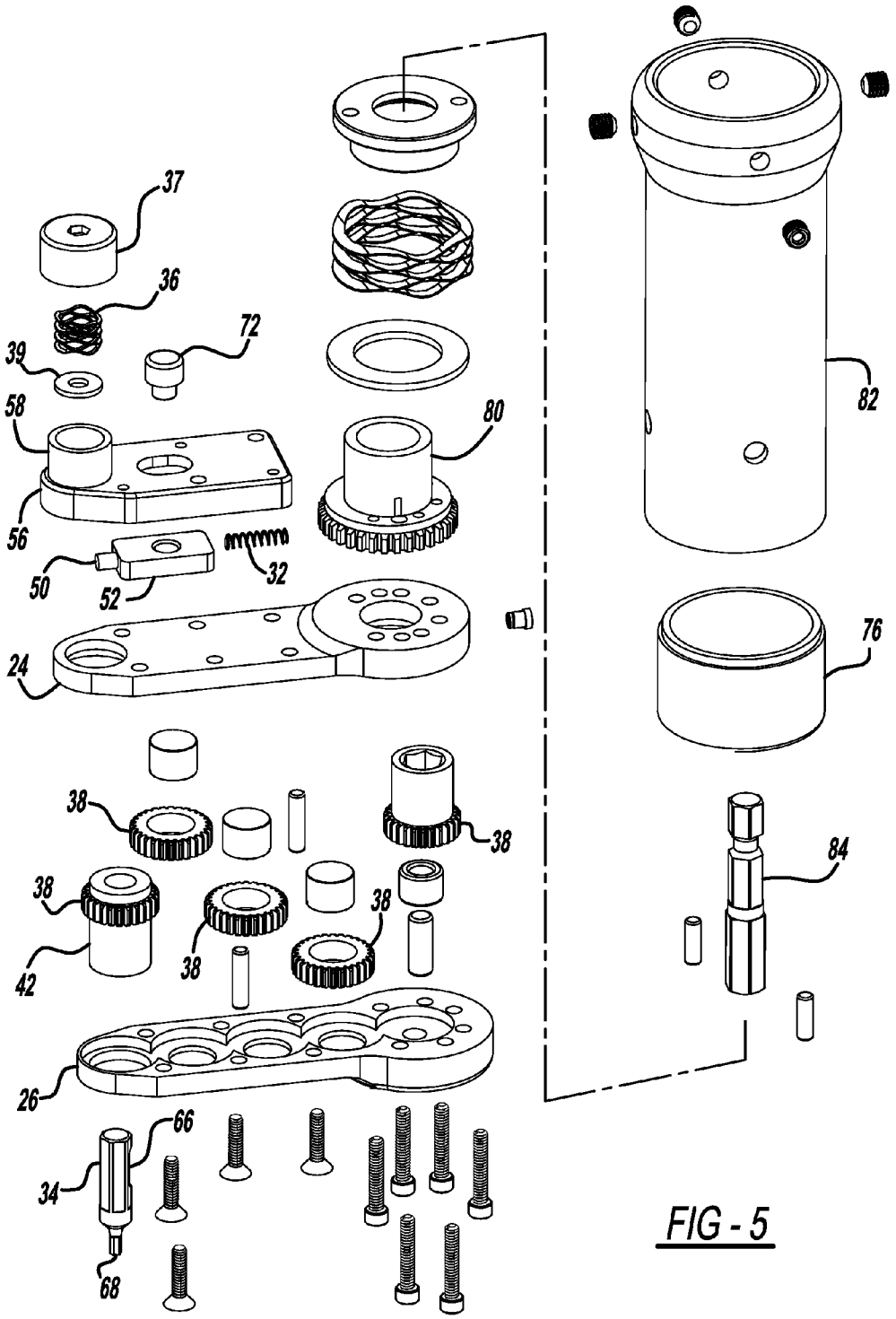
FIG. 5 is a partial cross-sectional view of the gear housing of the gear head of the fastener installation tool and an exploded view of the socket and hex key or hold bit in accordance with the present invention.

With reference to FIGS. 1-2, the fastener installation tool 10 gear head component 16 has a gear box 22 including upper 24 and lower 26 cover plates, a socket assembly 28, a retainer slide housing 56, a retainer slide 52 and biasing spring 32 and a hex key or holder bit 34 and associated release spring 36 which will be described in detail hereinafter.

With reference to FIGS. 1-5, the gear head 16 includes a gear box 22 having an upper cover plate 24 and a lower cover plate 26 defining the gear box 22 in a conventional manner. The gear head 16 is adapted to provide a quick-connect coupling to the drive end of the tool component 14 such as a rotary drive tool of the type well known in the art. Upon actuation of the tool component 14, the tool component 14 supplies rotary drive motion through a gear train 38 mounted in the gear box 22 of the gear head 16 to the socket gear 40. The socket 42 has a noncircular (i.e. hexagonal) seat 44 for receiving and rotatably driving the threaded nut 46. The hex key or hold bit 34 is mounted in a slip fit arrangement in a tubular bore 47 generally co-axially within the socket gear 40. One end 48 of the hex key or hold bit 34 is adapted to fit through the threaded nut (not shown) so as to avoid interference with installation of the threaded nut onto the threaded shank of the bolt fastener. The hex key or hold bit 34 is moved longitudinally within the tubular threaded bore of the threaded nut in a sliding displacement and constrained against rotation relative to the bolt fastener by the mating engagement of an extended rod portion 50 of a retainer slide 52 that resides in a slotted aperture 66 in the outer diameter of the hex key or hold bit 34 as will be hereinafter set forth in detail. The retainer slide 52 is mounted for sliding movement within a complementary cavity 54 in the bottom surface of a retainer slide housing 56 which itself is securely mounted to the top surface of the upper cover plate 24 of the gear housing 22. The retainer slide housing 56 also includes an upright boss 58 at one end thereof which includes a (noncircular/typically hexagonal) through passage 60 for receiving the end portion of the hex key or hold bit 34 in sliding engagement. The upright boss 58 further has a bore 62 larger than the through passage 60 for housing a spring 36 that exerts a force against the end of the hold bit or hex key 34 and is adapted to bias the hex key or hold bit 34 in a downward direction. A threaded cap 37 holds the spring 36 in the bore 62 of the upright boss 58. The spring 36 exerts sufficient downward force on the hex key or hold bit 34 to maintain the tip 68 of the hex key or hold bit 34 into continuous contact with the complimentary recess in the threaded shank of the fastener bolt while the threaded nut 46 is installed on the threaded shank of the fastener bolt. The hex key or hold bit 34 is secured in the through passage 60 of the upright boss 58 by the extended rod portion 50 of the retainer slide 52 by the force of a spring 32 biasing the retainer slide 52 in a direction towards the upright boss 58 and thereby moving and maintaining the extended rod portion 50 of the retainer slide 52 into a longitudinal slotted aperture 66 cut into the outside periphery of the hex key or hold bit 34.

The hex key or hold bit 34 is released from its position coaxial with the socket gear 40 by pulling back on a release trigger knob 72 mounted to the slide retainer 52 wherein when the slide retainer 52 is moved in a direction away from the upright boss 58 and the extended rod portion 50 of the retainer slide 52 moves out of the slotted aperture 66 in the outer periphery of the hex key or hold bit 34. The hex key or hold bit 34 is ejected from the socket gear 40 by the biasing force of the spring 36 housed in the bore 62 of the upright boss 58. This is easily accomplished by simply exerting a force on the release trigger knob 72 in a direction away from the upright boss 58.

An indexing head 74 is also mounted to the top surface of the upper cover plate 24. The indexing head 74 contains an indexing mechanism so that tool component 14 may be indexed relative to the gear head 16 to enable easy alignment of the hex key tip 68 with the broached hex key recess in the threaded shaft of the bolt fastener. An index sleeve 76 having an internal gear form thereon is mounted to an index body 80 having an external gear 81 meshing with the internal gear 77 of the index sleeve 76 which in turn is securely bolted to the upper cover plate 24 of the gear box housing 22. The index sleeve 76 also has an external threaded end 78 for receiving an internally threaded collar 82. The internally threaded collar 82 provides the interface between the power tool component 14 and the gear head 16. A drive adapter 84 is connected at one end to the power tool component 14 and an opposite end to a mating drive gear within the gear train 38.

In operation, the socket 42 of the socket gear 40 on the gear head 16 carries the threaded nut of appropriate size for power driven threaded engagement with the threaded shank of the fastener bolt. The hex key or hold bit 34 tip 68 is initially seated and engaged with the complimentary recess in the fastener bolt shank. When the power lever 18 is depressed to initiate driving of the socket gear 40, the threaded nut 46 and socket 42 are advanced along the threaded shaft of the bolt fastener towards the workpiece thereby moving in a downward direction relative to the hex key or hold bit 34 which remains seated and engaged within the complementary recess in the end of the threaded shank of the fastener bolt. During such relative movement of the socket 42, the hex key or hold bit 34 experiences relative upward movement displacement as a result of the socket's 42 downward displaced position, upon completion of the power drive threaded nut installation onto the fastener bolt. Such upward displacement of the hex key or hold bit 34 bears against the release spring 36 through a washer 39 and thereby causes the release spring 36 to compress. Throughout this movement, the release spring 36 maintains a downward bias force on the hex key or hold bit 34 to maintain the hex key or hold bit 34 tip 68 in engagement with the complimentary recess in the fasteners bolt shank. Also during this relative movement the slotted aperture 66 in the periphery of the hex key or hold bit 34 permits the extended rod portion 50 of the retainer slide 52 to slide along the bottom of the slotted aperture 66 to keep the hex key or hold bit 34 securely locked to prevent rotation thereof. Upon completion of the threaded nut installation, the gear head 16 and associated socket 42 and hex key or hold bit 34 are manually retracted from the fastener bolt and installed nut and may then be employed for installation of another nut onto another fastener bolt.

If any time during this operational procedure the power tool operator wishes to replace the hex key or hold bit 34, the fastener installation tool 10 is simply manually retracted from the fastener bold which results in the hex key or hold bit 34 being removed from the complimentary recess in the threaded shank of the fastener bolt. The operator further manipulates the release trigger knob 72 by overcoming the bias of spring 32 and sliding the retainer slide 52 in a direction away from the upright boss 58 which results in the extended rod portion 50 of the retainer slide 52 retracting from the slotted aperture 66 on the outer periphery of the hex key or hold bit 34 in turn allowing the hex key or hold bit 34 by the biasing force of the release spring 36 to be removed from the socket gear 40 and replaced with a new hex key or hold bit 34.

Although the invention has been described with reference to the preferred embodiment, it should be understood by those skilled in the art that the scope of the invention is not limited to that embodiment. Rather, changes to the details of the embodiment may be made without departing from the spirit and scope of the invention as claimed.

What is claimed is:

1. A fastener installation tool for installing a threaded nut onto the threaded shank of a fastener bold, said fastener installation tool comprising:

a tool component having a power drive tool; and a gear head component having a first end and a second end opposite said first end, said gear head component further comprising:

a gear box housing defining an upper cover plate attached to a lower cover plate, said upper cover plate having a top surface, said gear box housing further comprising at least one gear mounted between said upper and lower cover plates, said at least one gear comprising a socket gear;

a retainer slide housing mounted to said upper cover plate, said retainer slide housing having a lower surface facing and attached to said top surface of said upper cover plate;

a laterally extending boss portion at one end thereof;

a through passage centrally disposed in said laterally extending boss;

a cavity contiguous said top surface of said upper cover plate;

a slot having one end communicating with said cavity and an opposite end extending through said retainer slide housing to a top surface thereof; and a passage extending between said cavity and said through passage of said boss;

a retainer slide mounted in said cavity of said retainer slide housing, said retainer slide having an extended rod portion slidingly received in said passage extending between said cavity and said through passage of said boss;

a hold bit mounted in said through passage of said boss;

means for preventing rotatable motion of said hold bit while installing said threaded nut onto said threaded shank of said bolt fastener by use of said socket hear driven by said power drive tool;

means for providing lineal motion of said hold bit during installation of said threaded nut onto said threaded shank of said bolt fastener by use of said at least one socket gear that is attached to said power drive tool, said providing means further comprising second biasing means; and means for attaching said tool component to said gear head component.

2. The fastener installation tool as claimed in claim 1 further comprising:

a gear train mounted in said gear box housing, said gear train engaging said socket gear; and an indexing mechanism mounted to said top surface of said upper cover plate of said gear box housing, said indexing mechanism having an index body mounted to said top surface of said upper cover plate;

an index sleeve mounted to said index body and second biasing means biasing said index sleeve to said index body, whereby said indexing mechanism provides 360° indexing of said gear head with respect to said tool component.

3. The fastener installation tool as claimed in claim 2 wherein said means for attaching said tool component to said gear head component further comprises:

a drive adapter having one end attached to said tool component and an opposite end mounted to said gear train;

a collar surrounding said drive adapter, said collar having one end attached to said tool component and an opposite end attached to said index sleeve.

4. The fastener installation tool as claimed in claim 1 wherein said means for preventing rotatable motion of said hold bit further comprises:

a slotted aperture located on the periphery of said hold bit;

first biasing means mounted in said cavity of said retainer slide housing, said first biasing means biasing said retainer slide and extended rod portion in a direction towards said laterally extended boss portion whereby said extended rod portion is biased into said slotted aperture of said hold bit such that said hold bit is prevented from rotary motion during the installation of said threaded nut onto said threaded shank of said bolt fastener.

5. The fastener installation tool as claimed in claim 1 wherein said hold bit further comprises a narrowed non-circular end portion at one end thereof.

6. The fastener installation tool as claimed in claim 5 wherein said means for providing lineal motion of said hold bit further comprises:

said second biasing means being mounted in said through passage of said laterally extending boss, such that a biasing force is applied to said hold bit in a substantially longitudinal direction, said biasing force being insufficient to overcome the biasing force of said first biasing means so as to maintain said extended rod portion into said slotted aperture of said hold bit, said second biasing means force maintaining said narrowed non-circular end portion of said hold bit in a complimentary non-circular recess in the shank of said fastener bolt during engagement of said threaded nut onto said threaded shank of said fastener bolt.

7. The fastener installation tool as claimed in claim 1 wherein said power drive tool of said tool component is powered by pneumatic energy.

8. The fastener installation tool as claimed in claim 1 wherein said power drive tool of said tool component is powered by DC/AC electricity.

9. The fastener installation tool as claimed in claim 1 wherein said power drive tool of said tool component is powered by at least one battery.

10. The fastener installation tool as claimed in claim 1 wherein said power drive tool of said tool component is powered by hydraulic energy.

11. The fastener installation tool as claimed in claim 1 wherein said socket hear has a non-circular interior surface at one end thereof.

12. The fastener installation tool as claimed in claim 1 wherein the non-circular interior surface of the socket gear includes a flat surface.

13. A fastener installation tool for installing a threaded nut onto the threaded shank of a fastener bolt, said fastener installation tool comprising:

a tool component having a power drive tool;

a gear head having a first end and a second opposite end, said gear head further comprising:

a gear box housing defining an upper cover plate attached to a lower cover plate, said upper cover plate having a top surface, said gear box housing further comprising at least one gear mounted between said upper and lower cover plates, said at least one gear comprising a socket gear;

a retainer slide housing mounted to said upper cover plate, said retainer slide housing having a lower surface facing and attached to said top surface of said upper cover plate;

a laterally extending boss portion at one end thereof, said laterally extending boss having a centrally disposed through passage;

a cavity contiguous said top surface of said upper cover plate a slot having one end communicating with said cavity; and an opposite end extending through said retainer slide housing to a top surface thereof; and a passage extending between said cavity and said through passage of said boss;

a retainer slide mounted in said cavity of said retainer slide housing, said retainer slide having an extended rod portion slidingly received in said passage extending between said cavity and said through passage of said boss and a release tripper knob mounted on said retainer slide and extending through said slot of said retainer slide housing;

first means for biasing said retainer slide in a direction towards said boss portion of said retainer slide housing, said first biasing means mounted between one end of said retainer slide and a wall of said cavity in said retainer slide housing;

a hold bit slidingly mounted in said through passage of said boss portion, said hold bit having a slotted aperture along a periphery thereof;

second biasing means for biasing said hold bit axially, said second biasing means mounted within said through passage of said boss; and means for attaching said tool component to said gear head component whereby said first biasing means biases said extended rod portion of said retainer slide into engagement with said slotted aperture on said periphery of said hold bit to prevent rotation of said hold bit while said tool component installs said threaded nut onto the threaded shank of said bolt fastener and further whereby said second biasing means biases said hold bit axially such that when said first biasing means is overpowered by manually manipulating said release trigger knob mounted on said retainer slide and retracting said retainer slide and said extended rod portion from said slotted aperture, said second biasing means ejects said hold bit from said socket gear.

14. The fastener installation tool as claimed in claim 13 further comprising:

a gear train mounted in said gear box housing, said gear train engaging said socket gear; and an indexing mechanism mounted to said top surface of said upper cover plate of said gear box housing, said indexing mechanism having an index body mounted to said top surface of said upper cover plate;

an index sleeve mounted to said index body and second biasing means biasing said index sleeve to said index body, whereby said indexing mechanism provides 360° indexing of said gear head with respect to said tool component.

15. The fastener installation tool as claimed in claim 14 wherein said means for attaching said tool component to said gear head component further comprises:

a drive adapter having one end attached to said tool component and an opposite end mounted to said gear train;

a collar surrounding said drive adapter, said collar having one end attached to said tool component and an opposite end attached to said index sleeve.

16. The fastener installation tool as claimed in claim 13 wherein said hold bit further comprises a narrowed non-circular end portion at one end thereof.

17. The fastener installation tool as claimed in claim 13 wherein said power drive tool of said tool component is powered by pneumatic energy.

18. The fastener installation tool as claimed in claim 13 wherein said power drive tool of said tool component is powered by DC/AC electricity.

19. The fastener installation tool as claimed in claim 13 wherein said power drive tool of said tool component is powered by at least one battery.

20. The fastener installation tool as claimed in claim 13 wherein said power drive tool of said tool component is powered by hydraulic energy.

21. The fastener installation tool as claimed in claim 13 wherein said socket hear has a non-circular interior surface at one end thereof.

22. The fastener installation tool as claimed in claim 13 wherein the non-circular interior surface of the socket gear includes a flat surface.

* * * * *